US007175576B2

(12) United States Patent
Felberg et al.

(10) Patent No.: US 7,175,576 B2
(45) Date of Patent: Feb. 13, 2007

(54) EXERCISE DEVICE

(75) Inventors: Marc David Felberg, New York, NY (US); Margaret Tonne Goodman, New York, NY (US)

(73) Assignee: Goodmarc Designs Ltd., NYC., NY (US)

( * ) Notice: Subject to any disclaimer, the term of this patent is extended or adjusted under 35 U.S.C. 154(b) by 576 days.

(21) Appl. No.: 10/757,046

(22) Filed: Jan. 14, 2004

(65) Prior Publication Data

US 2005/0164854 A1 Jul. 28, 2005

(51) Int. Cl.
*A63B 23/02* (2006.01)
*A61F 5/00* (2006.01)

(52) U.S. Cl. ..... 482/140; 482/139; 602/18

(58) Field of Classification Search ..... 482/131, 482/139, 140, 148, 907; 602/18; 128/845
See application file for complete search history.

(56) References Cited

U.S. PATENT DOCUMENTS

| | | | | |
|---|---|---|---|---|
| 5,709,634 | A | 1/1998 | Pointer | |
| 5,857,948 | A * | 1/1999 | Barnett | 482/140 |
| 5,916,073 | A | 6/1999 | Ellis | |
| 5,921,903 | A | 7/1999 | Lawrence | |
| D438,577 | S * | 3/2001 | Phillips | D21/662 |
| 6,319,180 | B1 | 11/2001 | Kallassy | |
| D502,970 | S * | 3/2005 | Maakestad | D21/662 |

* cited by examiner

*Primary Examiner*—Glenn E. Richman

(57) ABSTRACT

The instant invention provides an exercise device where there is a central panel to retain the user's head and neck, and a pair of handles, the handles being attached to the central panel by an upper and lower strut, the overall strut shape being C-shaped, so that the handles may be threadedly retained thereon and adjusted in a rotatable and tiltable fashion, to maintain the head and neck in an immovable condition during abdominal exercise.

15 Claims, 3 Drawing Sheets

EXERCISE DEVICE

FIELD OF THE INVENTION

The present invention generally relates to exercise devices, and more specifically to a portable exercise device for stabilizing the head and neck during abdominal exercises.

BACKGROUND AND SUMMARY OF THE INVENTION

With the increasing interest in health issues, nutrition and exercise regimens, more people are utilizing exercise equipment in their search for good health and long life. Often, people who are new to physical "work-outs" utilize a variety of exercise equipment to aid in their quest. In fact, there is a vast array of equipment of almost every description from the very complex to the very simple. Recently, it has been found that many people who join gyms do so to tone the stomach and abdominal muscles. The most popular exercise for developing the abdominal muscles is the sit-up or crunch exercise. Most often this exercise is accomplished with the person lying prone on the floor with his or her hands placed behind the neck. As a result, undue stress is placed on the head and neck, and the stress increases as the person lifts himself upward, often by pulling or jerking the head and neck upward to raise the rest of the torso. A movement of this sort puts undue stress on the head, neck including the upper reaches of the spine. This pulling or jerking movement not only stresses the head and neck, but also defeats the purpose of the exercise, which is to solely utilize the abdominal muscles. As a result there is a great propensity to injure oneself during this activity, and at the very least the activity is unpleasant.

In order to maximize the exercise, a person must pull himself/herself upwards by the use of the abdominal muscles only. Generally, the greater the isolation of the muscle, the more the muscle is working and hence the greater result from being exercised. Hence, total isolation of the abdominal muscles during exercise, will maximize the impact of the exercise, and reduce the time necessary to obtain the desired result. When done properly, the exercise is taxing and repetitious. Sit-ups or crunches are grueling and in response, there have been many attempts to aid the user in this endeavor by providing a multitude of exercise devices.

To this end there are many types of exercise devices to aid in developing the abdominal muscles. There are basically the following types of devices: (1) wheel-type devices; (2) cage type devices; (3) board-type devices; (4) benches; (5) heavy mechanical devices where the user sits on the machine; (6) large inflatable balls; and (7) strap type devices. It is probable that a wheel device and the cage device are the best known and most often used. The wheel device while effective, unduly stresses the back and neck, while the cage device is ungainly, reduces the users' range of motion and allows the user to use his/her arm-strength for the exercise. Therefore, there is a recognized need for a portable device that on the one hand, allows the user a free range of motion while stabilizing the head and neck, while isolating the abdominal muscles. Many of these devices are bulky, expensive and compromise the most efficient method of completing the exercise.

The devices in accordance with the prior art may be further characterized by their relative ability to insure that the user is enabled to perform a crunch or sit-up without putting great pressure on the upper cervical spine and the head/neck area. To this end some devices of the board type insure that a large area is restricted from moving. Cage type devices do the same, by isolating the upper torso. The one problem with cage type devices is the placement of the hand and arms. Incorrect placement will endanger the user by shifting the stress point to the back and neck.

U.S. Pat. Nos. 6,319,180 and 2001/0029223A1 issued to Kallassy discloses an Abdominal Exercise Device and a Method of Use, wherein said invention has a semi-rigid pad that cradles the head, neck and upper back. The strap assemblies terminate in a handle area and it is disclosed that the strap assemblies are relatively long allowing the user to place his/her elbows facing forward. Another strap and pad device is U.S. Pat. No. 5,921,903, issued to Lawrence, which discloses a similar device where the arms are held facing outward. Furthermore, U.S. Pat. No. 5,857,948 issued to Barnett discloses yet another pad and strap assemblage with a similar mode of use.

U.S. Pat. No. 5,916,073 issued to Elliis and U.S. Pat. No. 5,709,634 issued to Pointer disclose rigid plate-like exercise devices. These devices cannot be adjusted and due to the inflexible nature require a single pose. Hence, there is not guarantee that the head and neck in respect to the elbows and arms are in the proper conformation.

A principal object of the instant invention is to provide an exercise device that stabilizes the head and neck area during exercises like sit-ups and crunches.

Yet another object of the instant invention is to provide an exercise device where the elbows are in alignment with the shoulders and at right angles to the head and neck.

Another object of the instant invention is to provide an exercise device that effectively isolates the abdominal muscles during exercise and optimizes the result of the exercise.

A principal object of the instant invention is to provide an exercise device that is small, easily transportable and can be stored easily.

Still another object of the instant invention is to provide an exercise device that is comfortable to use.

Another object of the instant invention is to provide an exercise device that is simple to operate and to use.

Yet another object of the instant invention is to provide an exercise device that can be used for other exercises.

The foregoing objects along with various features of the instant invention are pointed out with particularity in the claims, which are annexed hereto and form a part of the instant disclosure.

SUMMARY OF THE INVENTION

The instant invention utilizes a central panel adapted to accommodate the lower head upper neck area and may be of an overall rectilinear shape, being longer than it is wide. On the top corner of the horizontal peripheral leading edge of the central panel and top corner of the vertical peripheral leading edge is an attachment site for the upper and outer end of a C-shaped strut and on the bottom corner of the horizontal peripheral leading edge of the central panel and bottom corner of the vertical peripheral leading edge there is another attachment site for the C-shaped strut. On the opposite leading edges the process is repeated so as to affix a second C-shaped strut. Each C-shaped strut retains a handle. The handle possesses an annular space situated longitudinally therethrough so that each C-shaped strut passes through the annular space, and the handle surrounds the C-shaped strut so that the handle can be manipulated in a rotatable manner within 360 degrees and in a twisting maneuver within an angle of from about 180 degrees towards the panel and away from the central panel. The handles are infinitely adjustable within many angles. When grasped by the user the hands, neck and head are held immovably while the abdominal muscles are isolated for proper exercise. The user's elbows are perpendicular to the head and neck and in the same plane as the shoulders.

BRIEF DESCRIPTION OF THE DRAWINGS

It should be understood, by one skilled in the art, that the drawings depict certain embodiments of the invention and therefore are not to be considered a limitation in the scope of the instant invention, but that these and other advantages of the present invention will be more fully understood by reference to the following detailed description when read in conjunction with the attached drawings in which.

DETAILED DESCRIPTION OF THE PREFERRED EMBODIMENT

To wit, turning now with more specificity to the drawings, wherein like numerals refer to like parts throughout, the numeral 12 appertains generally to an exercise device. While the instant invention will be described in terms of an abdominal exerciser it should be noted that there are many other exercises and uses therefore. In this respect, it is to be understood that the invention is not limited in its application to an exercise device solely for abdominal exercise.

Figure 1:
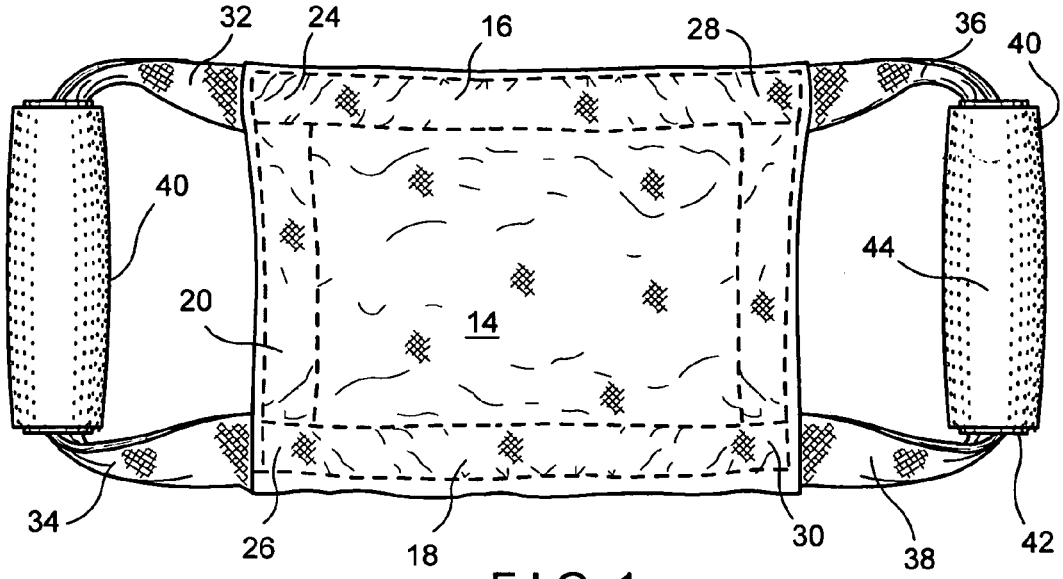
FIG. 1 is a side elevational view in perspective depicting an exercise device.

Exercise device 12, in accordance with FIG. 1, is essentially flat and rectilinearly shaped. Exercise device 12 has a central panel 14, which terminates in top horizontal peripheral area 16 on one side and bottom horizontal peripheral area 18 on the opposite side. Top horizontal peripheral area 16 and bottom horizontal area 18 are preferably maintained flat, by hems 48, 50, 52 and 54. Side peripheral areas 20 and 22 are maintained in a flattened conformation by hems 56, 58, 60 and 62.

Figure 4:
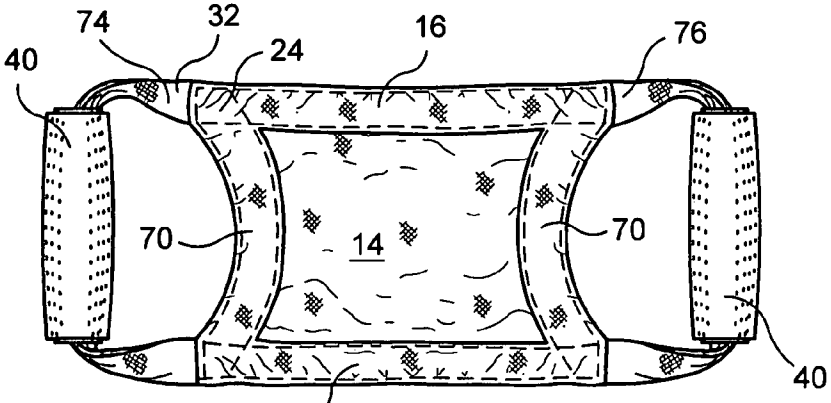
FIG. 4 is a side plan view showing an alternate embodiment thereof.
Figure 5:
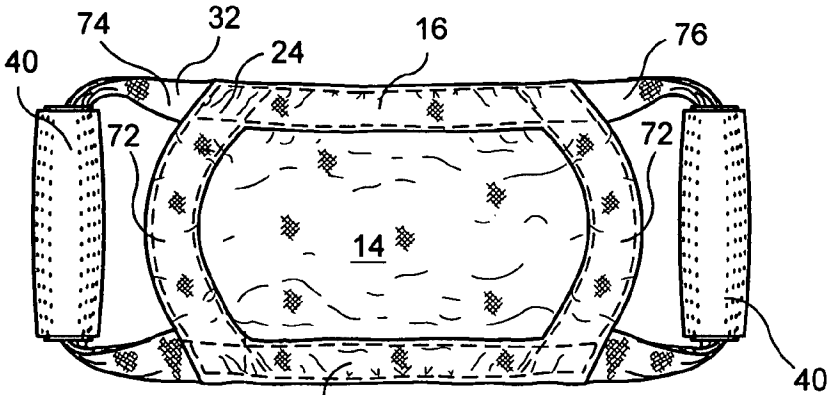
FIG. 5 is a side plan view showing an alternate embodiment thereof.

As a general rule and in accordance with FIGS. 1, 4 and 5 top horizontal peripheral area 16 should be parallel to bottom horizontal peripheral area 18. Side peripheral areas 20 and 22 do not have to be parallel, as seen in FIGS. 4 and 5.

Figure 2:
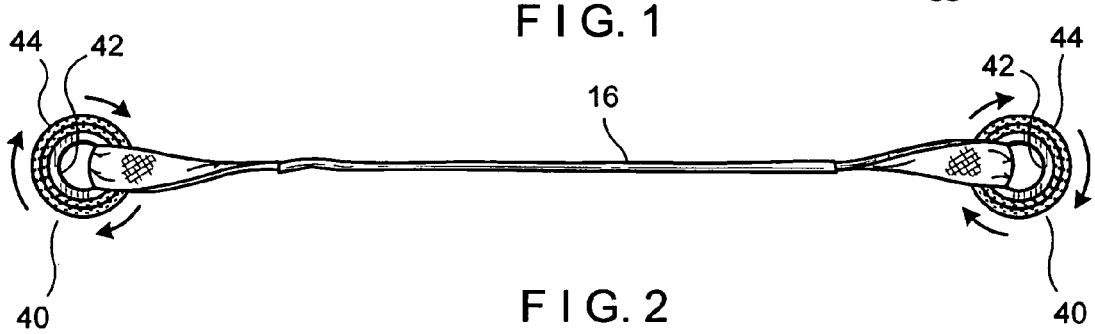
FIG. 2 is a top plan view, the bottom being an exact rendition thereof.

Peripheral areas 16 and 18 are most preferably constructed as by hemming so, in accordance with FIG. 2, hems 48 and 50 cooperate to form top horizontal peripheral area 16. Said area 16 remains flat in its most preferred configuration. It should be noted that in accordance with FIGS. 8, 9 and 10 that said peripheral areas 16, 18, 20 and 22 remains flat against the user's head and neck. Twisting, bunching or curling of the aforementioned areas prevents comfortable use of the device. As shown in FIGS. 4, 5, 6, and 7 flat side areas 70 and 72 may be concave or convex, curving in or curving out or angled in or angled out (not shown).

Returning to FIGS. 1 and 2 it is noted that central panel 14 is essentially flat and may be constructed from at least a single ply of material. While Nylon is the most preferred material, it should be noted that other hydrophobic polymeric materials may be operatively substituted. The preferred material is nylon from 200 denier to 1600 denier. Moreover, while being hydrophobic, the material should have good wicking properties so that residual moisture or perspiration travels away from the user. Dimensionally preferred for central panel 14 is a length, or from about 7 to about 9 inches and a width of from 4 to 6 inches. It is most preferred that the length of the central panel is 8 inches and the width is 5 inches.

Figure 6:
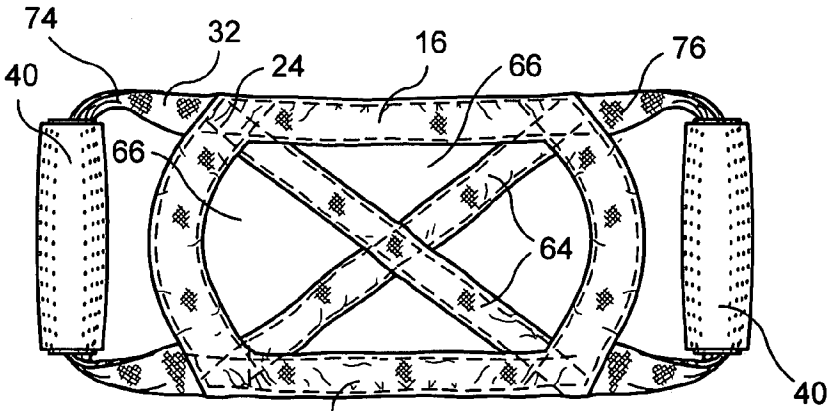
FIG. 6 is a side plan view showing an alternate embodiment thereof.
Figure 7:
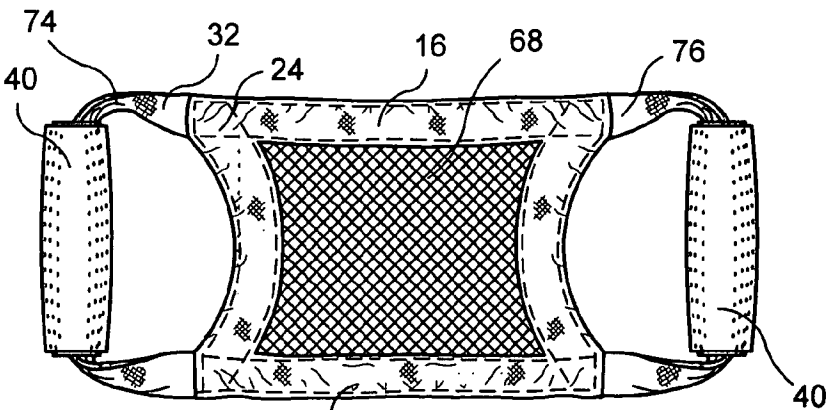
FIG. 7 is a side plan view showing an alternate embodiment thereof.

While central panel 14 is preferred to be rectilinear in shape, FIGS. 4, 5, 6, and 7 depict alternate embodiments. FIG. 6 shows an embodiment where a series of panes 66 are removed leaving X-shaped retention area 64. FIG. 7 illustrates an embodiment where central panel 14 is either a mesh, or a quilted mesh. In any event there are a multitude of different embodiments residing within the confines of top peripheral area 16, bottom peripheral area 18, side peripheral area 20 and central panel 14 that fall within the spirit of the disclosure.

Figure 3:
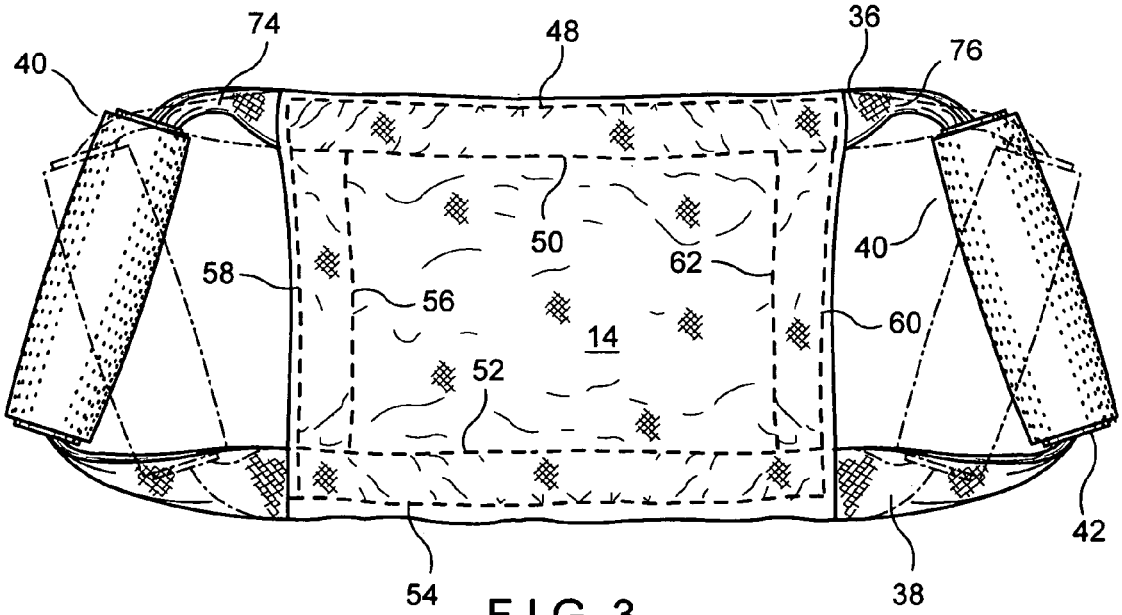
FIG. 3 is a side, elevational view depicting the movable grips thereof.

Turning now to FIGS. 1 and 3 central panel 14 may be of multiple plies and thereby create a layered assemblage. As another embodiment, there may be a padding between these layers, said padding is preferably a synthetic felt material, an encapsulated gel, a polymer fleece or quilt, an air bladder or any number of other pads. Notwithstanding the number of plies or the padding, central panel 14 is essentially flat in appearance. Although central panel 14 may be a variety of shapes as depicted in FIGS. 4 thru 7 as stated hereinabove a top area flat area 16 parallel to a bottom flat area 18 is critical to proper maintenance of position of the head, neck, hands and shoulders.

Returning to FIGS. 1, 2 and 3 handle assembly 40 is adjustably retained on a first strut 74 and a second strut 76 as illustrated in FIGS. 3 and 7. Struts 74 and 76 are infinitely adjustable by the user. In accordance with FIG. 2 handle assembly 40 is rotatable within 360 degrees, and in accordance with FIG. 3 tiltable within an angle of about 180 degrees. Struts 74 and 76 retain handle assemblies 40 so that the strut passes through an axial annular cylindrical chamber as disclosed herein, and retains handle assemblies 40 therethrough. Struts 74 and 76, may be constructed from a single or continuous piece of fabric, have on one side a top strut portion 32 and bottom strut portion 34, and on the opposite a top strut portion 36 and bottom strut portion 38. Top and bottom strut portions 32, 34, 36 and 38 cooperate to yield strut areas for adjustment of handle assemblies 40, so that handle assemblies 40 may be tilted towards central panel 14 and away from central panel 14. The angle and conformation of handle assemblies 40 are delimited by the length of struts 74 and 76.

With respect to FIG. 2, handle assembly 40 is preferably fashioned from a foamed grip 44 over an inner solid inner core as axial insert 42. Axial insert 42 is preferably constructed from a rigid hydrophobic polymer with a substantial degree of mechanical strength to generally retain its shape in a rigid condition. A rigid polymer would be useful in this regard having significant mechanical strength. Foamed grip 44 should be constructed from a hydrophobic polymer that does not retain or absorb perspiration. In its present configuration, exercise device 12 has at least two handle assemblies 40. Axial insert 42 defines an axial annular chamber which is open at both ends and creates a cylindrical chamber to retain strut 74 on one side and strut 76 on the other. As an alternate embodiment, there may be a second or additional axial insert 46, said insert being fashioned from a polymer with a tackier surface for better gripping of struts 74 and 76. Struts 74 and 76 retain handle assembly 40 so that each handle assembly 40 is not only rotatable in a 360 degree conformation but also tiltingly adjustable within an angle of about 180 degrees. Handle assembly 40 may alternately be constructed from a single material like wood, rigid polymer(s), composite material(s) (like carbon fiber), or metal(s) like (aluminum or titanium). In this alternate configuration handle assembly 40 which would be constructed from a single material, would still be rotatable and tiltingly adjustable as stated hereinabove.

Figure 9:
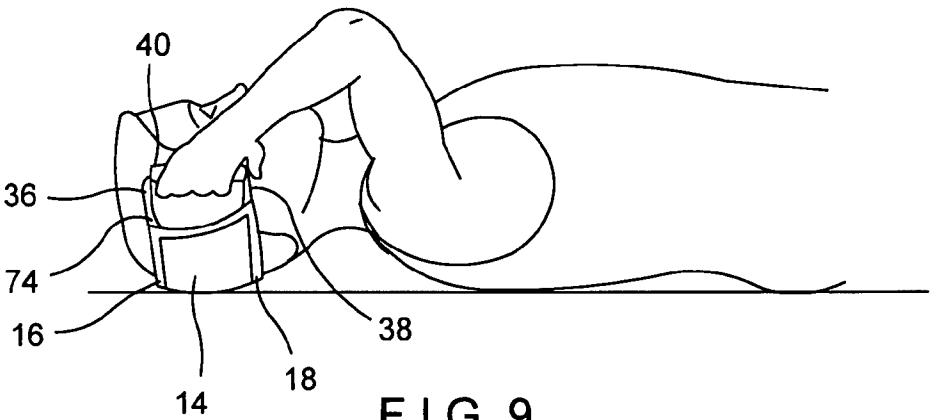
FIG. 9 is a side view showing a user thereof.
Figure 10:
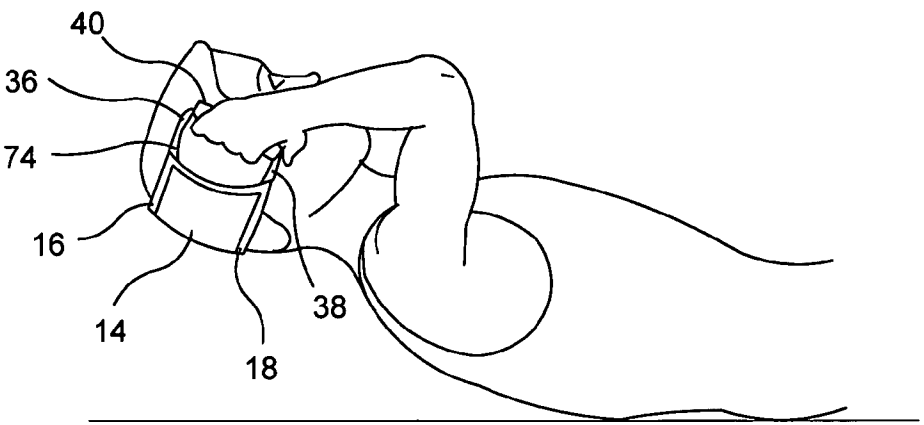
FIG. 10 is a side view thereof showing a user using the exercise device.
Figure 8:
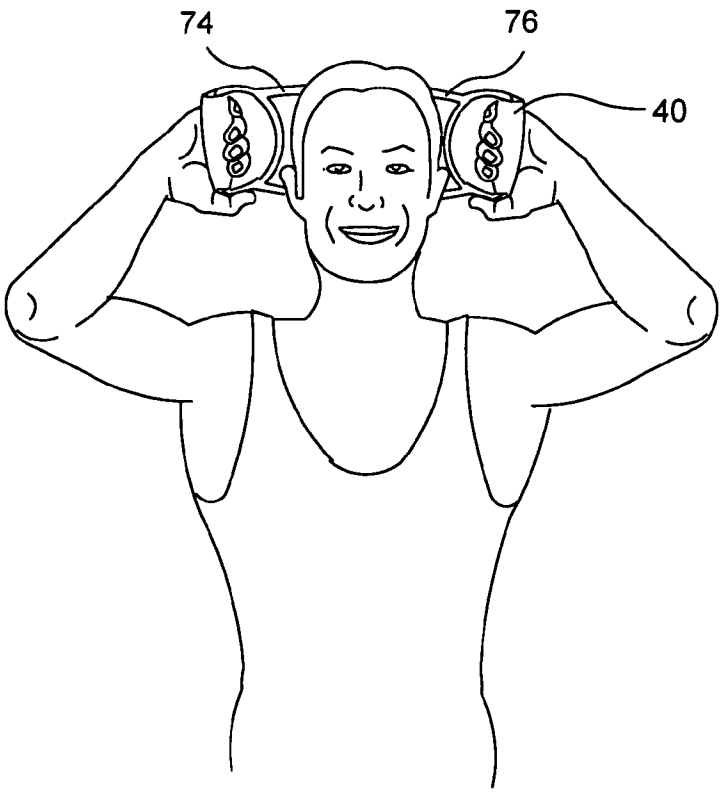
FIG. 8 is front view showing a user thereof.

Therefore, while held immovably affixed behind the user's head as in FIGS. 8,9 and 10 handle assembly 40 may be further adjusted for comfort, proper conformation of the hands, elbows, neck and head, and thereby insures isolation of the abdominals. Overall, handle assembly 40 is essentially rigid with little deformation from a center-line. While axial insert 42 and alternately including additional axial insert 46 are preferably constructed from a hard polymeric cylinder, it should be noted that it is most preferred that the polymer is not overly abrasive. In addition, it is preferred that foam grip 44 is fashioned from a closed cell polymer that is essentially spongy to the touch and conforms to the user's hand but, which does not absorb or retain moisture and perspiration. Handle assembly 40 may be from about 3 inches to about 5 inches in length with an inside diameter of about from 0.35 inches to about 1.75 inches. It is most preferred that handle assembly 40 is about 4.5 inches in length and has an inside diameter of about 1 inch.

Turning now to FIGS. 1, 2, 3, 4, 5, 6 and 7, struts 74 and 76, most preferably arise from using polymer webbing. The webbing may be constructed from nylon, polypropylene or polyester. Polymeric materials are preferred for their of resistance to abrasion, mildew, ultraviolet light, and acids/alkalis. Moreover, as a cost factor, the aforementioned synthetic polymers are most preferred. Therefore, a most preferred material is a polypropylene webbing. Said webbing, being manufactured as a "rough-weave" polypropylene webbing is preferably suited as it provides a multiple number of purchase holds. As shown by FIG. 3 handle assembly 40 and axial insert 42 may be tilted so that axial inset 42 contacts the rough weave of struts 74 and 76 and is held thereon by the user. Struts 74 and 76 are preferred to be in an essentially C-shape which allows for handle assembly 40 to be threadedly retained thereon. The C-shape or U-shape facilitates sowing so that attachments 24, 26, 28, and 30 can be provided. Other shapes may be operatively employed as by utilizing a two-step sewing process. For example a D-shape, O-shape may be employed using a two-step sewing operation. Struts 74 and 76 may be fashioned from either a continuous piece of material or from disparate pieces. Therefore if fashioned from a continuous piece of material, said material runs the length of top flat area 16 and bottom flat area 18 such that the length of said continuous piece of material is from about 32 inches to about 41 inches. If said struts are fashioned from disparate or individual pieces the piece length can be a function of manufacturer's choice. Notwithstanding the foregoing, it is preferred that struts 74 and 76 are from about 5 to about 12 inches in overall length with an individual length of from about 2. inches to about 6 inches measured from each corner of central panel 14 to the leading edge of handle assembly 40.

In order to secure struts 74 and 76 of FIG. 3 an attachment by means of sewing is the preferred manner. Therefore, top flat area 16 and hems 48 and 50 are continued to attach the upper part of strut 74 on one side and the upper part of strut 76 on the other side to the corners of central panel 14. The same holds true for hems 52 and 54 to attach the lower part of strut 74 on one side and the lower part of strut 76 on the other side. It is preferred that there be at least a pair of struts 74 and 76, said struts 74 and 76 attached to the peripheral corners of central panel 14 at attachment sites 24, 26, 28 and 30. As but one alternate embodiment, the attachment site of struts 74 and 76 can be successfully effected outside of central panel 14.

Central panel 14, as at least a single ply, in accordance with FIGS. 1, 3, 4, and 5 is most preferably constructed from a material like nylon or other synthetic polymer having a denier from about 200 to about 1600. Other materials may also vary with the inclusion of "ripstop" nylon, polyester cloth, microfiber polyester wickable fleece, neoprene, a polyester heavy fleece, breathable membrane fabric, vinyl fabric, and combinations thereof. As yet other embodiments leather, synthetic leather, suede leather, "sueded" synthetic leather and combinations thereof are also suitable. With regard to FIG. 7, in one embodiment a mesh central panel 68 may be of from about 0.8 m to about 30 mm may be used, said mesh being fashioned from nylon or polyester. The mesh may be a square, hexagon, or any other regular polygonal shape.

While it is preferred that central panel 14 be constructed from at least a ply of material, more than one ply may be employed. For example, the plies may be formed by folding the material, placing materials one on top of the other, sandwiching materials and integrally forming materials as a layer. As a sandwich materials of different characteristics may be joined in operative unison. One such sandwich configuration is waterproof outer layers with a cushioned inner layer, like vinyl waterproof outer layers sandwiching a synthetic felt inner layer. Multiple plies give rise to other utilities. For example given two or more plies, and with hem 20 or hem 22 being either omitted or partially sewn on one end a pouch is formed by the open end on one side and closed by the full hem on the other. The pouch formed thereby, may be left in an open condition or closed by a snap, zipper or other closure to secure personal articles therein.

In accordance with the aforementioned figures, there are critical dimensions relating to exercise device 12, in order to insure that the elbow arm placement is maximized the panel should be from about 2 to about 6 inches from the upper surface to the attachment site of the strut and from about 2 to about 6 inches wide between the attachment sites of strut 74 and strut 76.

It is most preferred materials a nylon for central panel 14 and ballistic cloth a rough weave polypropylene or nylon for the struts 74 and 76, although materials may run the gamut from leather and silk to some of the more esoteric synthetic polymeric materials. Given its intended use, exercise device 12 is preferred to repel water, perspiration and bacteria that dwells therein. Therefore a variety of waterproof and water-resistant materials are well suited for central panel 14. For example, a waterproof nylon, a vinyl fabric or a Teflon coated fabric (Goretex-type fabric) or any number of water-resistant fabrics may be operatively substituted. It is inherent that exercise device 12 may be hand-washed.

As a general rule, it is desirable that the head and neck remain immovably aligned during a sit-up or crunch exercise. The greatest mistake made during this exercise is to move the head toward the chest and basically hoist the rest of the body upwards by throwing the head and neck forward. To complete the exercise correctly, one must lift the body while keeping the head and neck in a position essentially in alignment with the spine.

FIGS. 8, 9 and 10 depict a user, employing exercise device 12. A person who wishes to utilize exercise device 12 for purposes of abdominal exercise grasps handle assembly 40 in one hand and handle assembly 40 in the other, while his/her elbows are aligned with the shoulders, and while the hands are aligned with the head and neck such that central panel 14 retains the lower head and upper neck area. A user can then manipulate handle assembly 40 by tilting and rotatably adjusting said handle assembly 40. This physical conformation encourages effective isolation of the abdominal muscles by preventing the user from utilizing the arms, or throwing the head/neck forward to thereby hoist the rest of the body. As shown by FIG. 10 the head and neck remain aligned with the spine and reduces the likelihood that the head and neck will be tilted forward or thrusted forward and up.

With reference to FIGS. 8, 9 and 10 the user reclines with exercise device 12 positioned behind the head and cradling the upper neck and head thereby. Grasping handle assembly 40, the user aligns the elbows with the collarbone creating a single plane of head, neck, elbows arms and shoulders. As depicted in FIG. 8 the supine individual, grasping exercise device 12 can contract the abdominal muscles to raise the body upward in the traditional crunch exercise.

While the foregoing embodiments of the invention have been set forth in considerable detail for the purposes of making a complete disclosure of the invention, it will be apparent to those of skill in the art that numerous changes may be made in such details without departing from the spirit and the principles of the invention.

We claim:

1. An exercise device comprising:

a central panel adapted to retain a person's head and neck in an essentially immovable position;

at least a pair of struts in communication with said central panel on one side and at least a pair of struts in communication with said central panel on the opposite side; and a handle assembly on one side retained by said at least pair of struts and another handle assembly on the other side retained by said at least pair of struts, so that said handle assembly can be manipulated by a user; said handle assembly forming a longitudinal annular chamber running lengthwise adapted so that said strut threadedly retains said handle assembly, said handle assembly slides therein and said handle assembly may be tilted and adjusted by the user within an angle of 180 degrees.

2. A central panel as described in claim 1 wherein said central panel is fashioned from at least a single ply of material.

3. A central panel as described in claim 1 wherein said central panel is fashioned from at least two plies of material.

4. A central panel as described in claim 1 fashioned from at least a ply of nylon.

5. A central panel as described in claim 1 wherein said central panel is fashioned from at least two plies thereby forming a pouch within.

6. A central panel as described in claim 1 wherein said central panel is fashioned from a hydrophobic polymeric cloth.

7. A central panel as described in claim 1 wherein said central panel is essentially rectilinear in shape.

8. A pair of struts as described in claim 1 wherein said struts are C-shaped.

9. A pair of struts as described in claim 1 wherein said struts are fashioned from a polymeric cloth.

10. A pair of struts as described in claim 1 wherein said struts are fashioned from a rough weave polymeric cloth.

11. A handle assembly as described in claim 1 wherein said handle is further comprised of a foam grip.

12. A handle assembly as described in claim 1 wherein said handle is comprised from a group consisting of: wood, metal, rigid polymers, carbon fiber and combinations thereof.

13. A handle assembly as described in claim 1 wherein said handle is rotatable within an angle of 360 degrees.

14. A central panel as described in claim 1 that is from about 4 to about 6 inches in width and from about 7 to about 9 inches in length.

15. A central panel as described in claim 1 that is from about 5 inches in width and from about 8 inches in length.

* * * * *